US005271166A

United States Patent [19]

Theurer

[11] Patent Number: 5,271,166

[45] Date of Patent: Dec. 21, 1993

[54] CONVEYOR CHAIN ARRANGEMENT FOR BALLAST CLEANING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 963,824

[22] Filed: Oct. 20, 1992

[30] Foreign Application Priority Data

Oct. 24, 1991 [AT] Austria ..... 2124/91

[51] Int. Cl.[5] ..... E01B 27/04

[52] U.S. Cl. ..... 37/104; 171/16; 104/2

[58] Field of Search ..... 171/16; 37/104, 105, 37/106, 107; 104/2, 7.3

[56] References Cited

U.S. PATENT DOCUMENTS

| | | | |
|---|---|---|---|
| 2,886,904 | 5/1959 | Kershaw | 37/104 |
| 3,850,251 | 11/1974 | Plasser et al. | 171/16 |
| 4,355,687 | 10/1982 | Theurer et al. | 171/16 |
| 4,614,238 | 9/1986 | Theurer et al. | 171/16 |
| 4,882,860 | 3/1990 | Whitaker, Jr. | 37/104 X |

FOREIGN PATENT DOCUMENTS

| | | | |
|---|---|---|---|
| 207401 | 12/1958 | Austria | 104/2 |
| 210458 | 4/1959 | Austria | 37/104 |
| 2226612 | 1/1973 | Fed. Rep. of Germany . | |
| 883638 | 12/1961 | United Kingdom . | |
| 2063971 | 6/1981 | United Kingdom | 171/16 |

*Primary Examiner*—Randolph A. Reese
*Assistant Examiner*—Arlen L. Olsen
*Attorney, Agent, or Firm*—Collard & Roe

[57] ABSTRACT

A conveyor chain arrangement for a track maintenance machine is mounted on the machine frame for receiving and conveying ballast and comprises two separate and independently operable ballast receiving and conveying units at opposite sides of the machine frame extending alongside the track. Each unit comprises a vertically and transversely adjustable chain track extending longitudinally in an oblique plane with respect to the track plane adjacent a respective machine frame side, each chain track consisting of two track sections. Drives are connected to the chain track for vertically and transversely adjusting the chain track, and an endless ballast excavating and conveying chain is guided in the chain track, and comprises a chain drive for the chain. A ballast excavating beam has one end pivotally connected to a lower end of the chain track for pivoting about a vertical axis in a horizontal plane underneath and parallel to the track plane during operation whereby the effective width of ballast excavation may be changed, an upper end of the chain track providing a ballast discharge station is spaced from the ballast excavating beam in a longitudinal extension of the machine frame and the lower chain track end forms a bent transition to the ballast excavating beam. The bent transition has an end leading and extending parallel to the track plane.

14 Claims, 2 Drawing Sheets

CONVEYOR CHAIN ARRANGEMENT FOR BALLAST CLEANING MACHINE

BACKGROUND OF THE INVENTION

1. Field of the Invention

The present invention relates to a conveyor chain arrangement for a track maintenance machine, such as a ballast cleaning machine, comprising a machine frame, the conveyor chain arrangement being mounted on the machine frame for receiving and conveying ballast supporting a track defining a plane, and the conveyor chain arrangement comprising a vertically and transversely adjustable chain track extending longitudinally in an oblique plane with respect to the track plane adjacent a respective one of the machine frame sides, drive means connected to the chain track for vertically and transversely adjusting the chain track, an endless ballast excavating and conveying chain guided in the chain track, a chain drive for the chain, and the chain track including a ballast excavating beam extending in a horizontal plane underneath and substantially parallel to the track plane during operation and having an upper end providing a ballast discharge station spaced from the ballast excavating beam in the direction of a longitudinal extension of the machine frame and the lower chain track end forming a bent transition to the ballast excavating beam. The bent transition has an end leading and extending substantially parallel to the track plane.

2. Description of the Prior Art

U.S. Pat. No. 3,850,251 discloses such a conveyor arrangement on a track-bound ballast cleaning machine. While the machine is continuously moved on the track in an operating direction, the endless ballast excavating and conveying chain is guided along the ballast excavating beam underneath the track to excavate the ballast and the excavated ballast is conveyed upwardly along the chain track to a ballast cleaning screen arranged rearwardly of the ballast excavating beam in the operating direction and is there discharged for cleaning. The endless chain then moves downwardly along the opposite machine frame side back to the ballast excavating beam. A chain drive is arranged at the upper turning point of the chain, i.e. at the ballast discharge station. The bent lower ends of the two longitudinally extending chain track parts at the opposite sides of the machine frame are interconnected by the ballast excavating beam which consists of two parts linked to each other and to the lower chain track part ends. These ballast excavating beam parts may thus be pivoted into a V-formation to adjust the effective operating width of the ballast excavating beam. In this way, the conveyor arrangement may be used in tangent track as well as track switches where the ballast bed is much wider than in tangent track.

A similar ballast cleaning machine with a ballast excavating beam whose operating width may be adjusted has been disclosed in U.S. Pat. No. 4,614,238. In this conveyor arrangement, the two ballast excavating beam parts are either linked together or telescopingly connected, and a drive is provided for adjusting the length of the beam to the width of the ballast bed to be cleaned. When the length of the ballast excavating beam is adjusted, the length of the endless ballast excavating and conveying chain must be correspondingly changed to assure a proper guidance of the endless chain in the chain track.

U.S. Pat. No. 4,882,860 deals with a ballast excavating machine comprising an endless chain undercutter which is vertically adjustable at one side of the machine frame and may be pivoted about a vertical axis for operating beneath the track. The excavated ballast is upwardly conveyed and discharged onto a longitudinally extending conveyor for removing the excavated ballast. In its operating position, the undercutter cannot be vertically adjusted, which prevents adjustment of the excavating depth in accordance with changing operating conditions. The acute angle between the horizontally extending undercutter part beneath the track and the undercutter part rising to convey the excavated ballast to the removal conveyor makes the deflection of the endless chain from one to the other part difficult and subjects the chain to excessive wear. Also, this arrangement requires considerable space on the track shoulder, which substantially reduces the usefulness of the arrangement in track switches.

German patent application No. 2,226,612, published Jan. 4, 1973, discloses a ballast cleaning machine comprising two separate and independent ballast excavating units vertically adjustably arranged at respective sides of the machine frame and each having an endless excavating chain. The units are pivotal on the machine frame about horizontal axes extending transversely of the track. At the beginning of the operation, the ballast excavating units are pivoted into engagement with the ballast shoulders and are then turned about vertical axes into an operating position underneath the track. The excavated ballast is deposited along the shoulders alongside each machine frame side and must then be conveyed by bucket chains or conveyors to a ballast cleaning screen.

British patent No. 883,638 similarly discloses a ballast cleaning machine with two excavators comprising endless cutter chains mounted at the opposite sides of the machine frame for pivoting about vertical axes to extend underneath the track. The excavated ballast must be conveyed upwards from the track shoulders by elevators and is stored for removal on longitudinally extending conveyors. The structure is very complicated and inefficient in operation.

SUMMARY OF THE INVENTION

It is the primary object of this invention to provide a conveyor chain arrangement for a track maintenance machine comprising a machine frame of the first indicated type, which requires a minimum time for adjustment to operate in track sections with ballast beds of different widths, such as tangent track and track switches.

The invention accomplishes this and other objects with a conveyor chain arrangement mounted on the machine frame for receiving and conveying ballast supporting a track defining a plane, which comprises two separate and independently operable ballast receiving and conveying units at opposite sides of the machine frame extending alongside the track, each unit comprising a vertically and transversely adjustable chain track extending longitudinally in an oblique plane with respect to the track plane adjacent a respective one of the machine frame sides, each chain track consisting of two track sections, drive means connected to the chain track for vertically and transversely adjusting the chain track, an endless ballast excavating and conveying chain guided in the chain track, and a chain drive for the chain. The ballast excavating beam has one end pivotally connected to a lower end of the chain track for pivoting about a substantially vertical axis in a horizontal plane underneath and substantially parallel to the track plane during operation whereby the effective width of ballast excavation may be changed, an upper end of the chain track providing a ballast discharge station spaced from the ballast excavating beam in the direction of a longitudinal extension of the machine frame and the lower chain track end forming a bent transition to the ballast excavating beam. The bent transition has an end leading and extending substantially parallel to the track plane. The upper chain track end preferably projects above a ballast cleaning screen for discharging the excavated and conveyor ballast onto the screen.

This arrangement retains the commercially proven, efficient concept of the upward conveyance of the excavated ballast along an obliquely extending chain track extending longitudinally in the direction of the machine frame extension while enabling the excavating width to be rapidly adjusted without any problem to conform to different ballast bed widths. All that is needed is a transverse adjustment of the ballast excavating beams to change the degree of overlap of the two beams. This adjustment of the operating width may be effected steplessly and without interrupting the ballast excavating operation, and no change in the length of the endless chains is required, which is a labor-intensive and time-consuming operation. Since the two ballast excavating units can cut into the ballast bed from the track shoulders, they can be put into operation rapidly and without much labor-intensive and time-consuming preparatory work.

According to a preferred feature, the ballast excavating beams of the two units are staggered from each other in the longitudinal machine frame extension direction, each excavating beam being arranged for receiving and conveying ballast from opposite sides of the track with respect to a longitudinal center line of the track. This makes it possible to work in track switches without interruption in the forward movement of the machine. All that is required is for the operator in the cab of the machine to pivot one or both ballast excavating beams by remote control to change the transverse position thereof. No interruption of the operation is necessary with this minimal operational step.

To provide a very simple and robust structure, the ballast excavating beams may be pivotal between end positions extending respectively substantially parallel to the center line of the track and transversely thereto, and pivoting drives are provided for pivoting the ballast excavating beams. The ballast excavating beam has opposite longitudinally extending guide faces arranged to receive and guide the endless excavating and conveying chain, and a guide sprocket at a free end opposite the one ballast excavating beam end guides the endless chain from one of the guide faces to the opposite guide face. Such a structure is readily remote controlled for pivoting the ballast excavating beams into their operating positions underneath the track and for adjusting their operating widths.

According to a preferred embodiment, the conveyor chain arrangement further comprises a deflection plate mounted at the lower chain track end adjacent the pivoting axis and remote from the respective machine frame side, the deflection plate extending in a vertical plane substantially parallel to the track. This assures that the excavated ballast is fully deflected onto the rising chain track for conveyance to the discharge station, rather than being uncontrolled thrown onto the track shoulder by centrifugal forces.

If the chain track is universally movably pivoted to the machine frame near the upper end thereof, it may be pivoted without hindrance in all directions to be adapted to all operating conditions.

According to another preferred embodiment, the two chain track sections are vertically staggered in an operative position alongside the machine frame. This reduces the space requirements directly at the ends of the track ties, which enables the machine to be used under the most unfavorable space conditions, for example in the transition zones between track switches and tangent track where the long switch ties are changed again to the regular track ties.

If the ballast excavating beams of the two units are staggered from each other in the longitudinal machine frame extension, the beams have a length corresponding approximately to a length of a regular track tie, and a leading ballast excavating beam in an operating direction is longer than the trailing ballast excavating beam, the two beams may be maximally pivoted into cooperation with each other for operation in tangent track while a maximal operating with may be achieved in track switches.

Preferably, the endless ballast excavating and conveying chain is comprised of excavating shovels having scraping fingers at their ends and universal links connecting the excavating shovels, and guide rollers at a side of the ballast excavating and conveying chain facing the respective machine frame side are arranged adjacent the vertical pivoting axes of the ballast excavating beam for engaging the scraping fingers of the excavating shovels and are freely rotatable about vertical axes spaced from the chain track and the ballast excavating beam. Such a chain may be guided in all directions without problems and with a minimum of wear and maximal dependency.

A chain tensioning device for maintaining a constant tension of the endless ballast excavating and conveying chain is preferably mounted on the chain track closer to the upper than the lower end thereof. This will compensate for a change in the length of the path of the endless chain when the ballast excavating beam is pivoted about its vertical axis so that the chain tension remains constant and uniform.

According to yet another preferred embodiment, an auxiliary chain is vertically adjustably mounted on the machine frame ahead of the unit in an operating direction, and a drive is provided for vertically adjusting the auxiliary chain. This enables a ditch to be cut into the ballast in the track shoulders at the beginning of the operation so that the ballast excavating beam extending in the direction of the machine frame extension may be lowered into the ditch below the track plane, whereupon it may be pivoted in a horizontal plane parallel thereto to extend transversely below the track plane.

BRIEF DESCRIPTION OF THE DRAWING

The above and other objects, advantages and features of the present invention will become more apparent from the following detailed description of now preferred embodiments thereof, taken in conjunction with the accompanying somewhat diagrammatic drawing wherein.

DETAILED DESCRIPTION OF PREFERRED EMBODIMENTS

Figure 1:
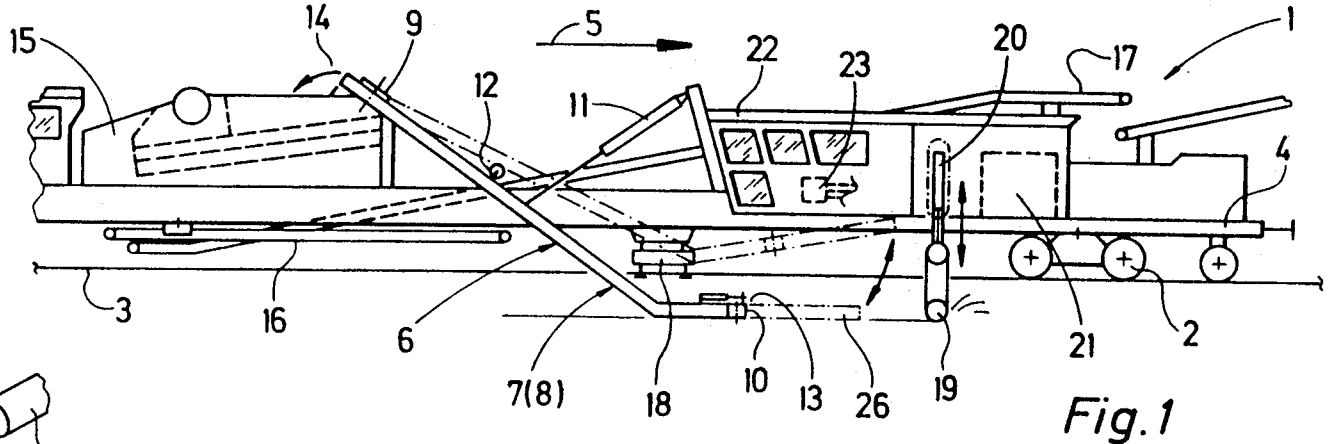
FIG. 1 is a simplified fragmentary side view of a ballast cleaning machine incorporating a conveyor chain arrangement according to this invention.

Referring now to the drawing and first to FIG. 1, there is shown a track maintenance machine constituted by ballast cleaning machine 1 comprising machine frame 4 having a longitudinal extension in an operating direction indicated by arrow 5. The machine frame is supported on track 3 by undercarriages 2 (only the front undercarriage being shown in fragmentary FIG. 1) for movement in the operating direction.

Figure 2:
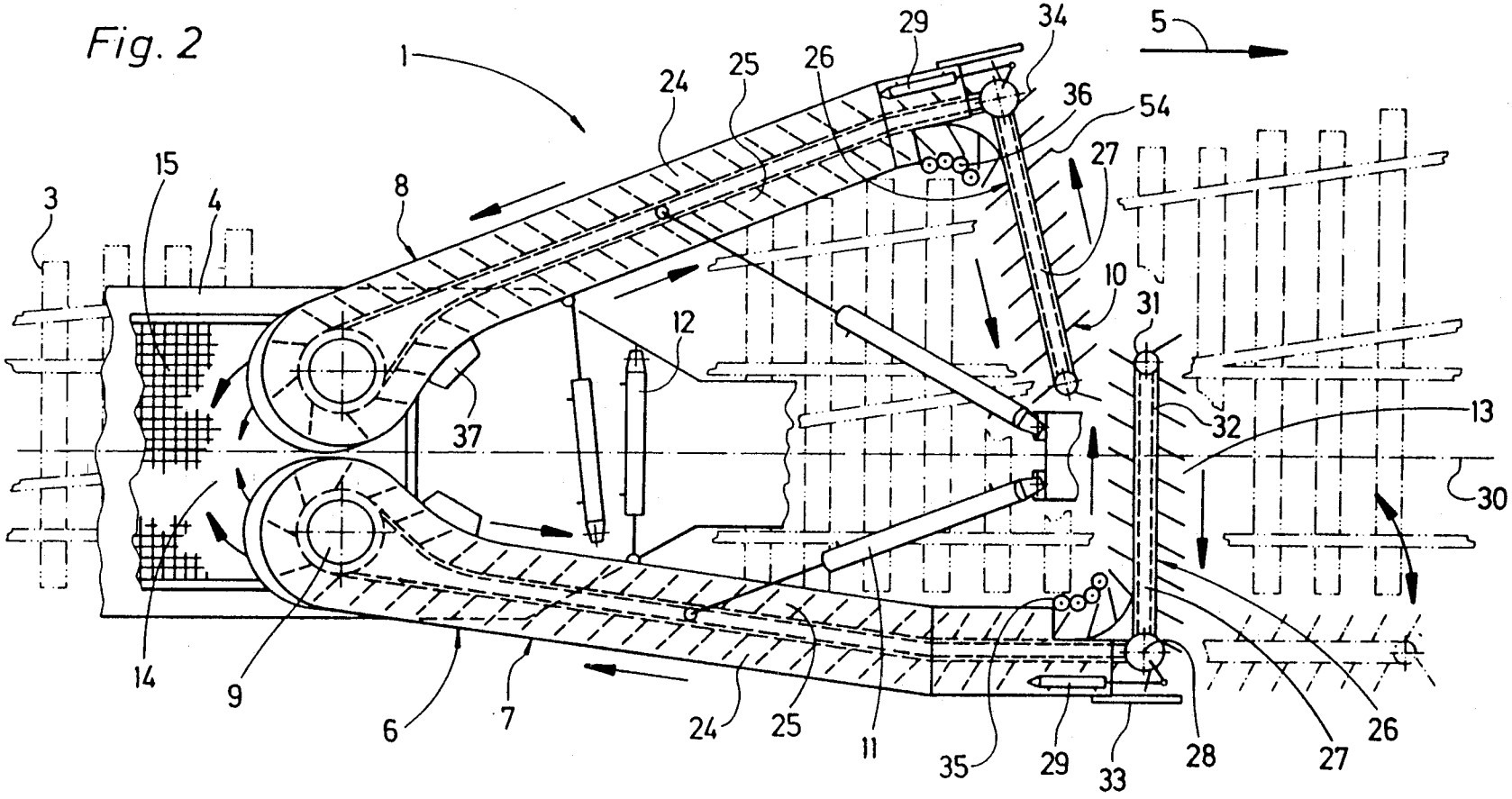
FIG. 2 is an enlarged top view showing the two ballast excavating units of the arrangement of FIG. 1.

Conveyor chain arrangement 6 is mounted on machine frame 4 for receiving and conveying ballast supporting track 3 defining a plane. As shown in detail in FIG. 2, the conveyor chain arrangement comprises two separate and independently operable ballast receiving and conveying units 7, 8 at opposite sides of machine frame 4 extending alongside track 3. Each unit comprises a vertically and transversely adjustable chain track extending longitudinally in an oblique plane with respect to the track plane adjacent a respective one of the machine frame sides, and each chain track consists of two track sections 24 and 25 arranged adjacent each other in a direction extending transversely to machine frame 4 and track 3. Drive means comprised of vertical drive 11 and transverse drive 12 are connected to the chain track 24, 25 for vertically and transversely adjusting the chain track, and endless ballast excavating and conveying chain 10 is guided in the chain track for receiving ballast at excavating point 13 underneath track 3 and conveying the excavated ballast to discharge station 14 trailing the excavating point in the operating direction and being positioned higher than the excavating point. Chain drive 9 is provided for chain 10. Endless chains 10 are driven in opposite directions so that units 7 and 8 convey the excavated ballast to the opposite track shoulders. Ballast excavating beam 26 has one end pivotally connected to a lower end of the chain track for pivoting about substantially vertical axis 28 in a horizontal plane underneath and substantially parallel to the track plane during operation whereby the effective width of ballast excavation may be changed. An upper end of the chain track provides ballast discharge station 14 spaced from ballast excavating beam 26 in the direction of a longitudinal extension of machine frame 4 while the lower chain track end forms a bent transition to the ballast excavating beam. The bent transition has an end leading and extending substantially parallel to the track plane, as best shown in FIG. 1. As shown in FIGS. 1 and 2, the upper chain track end projects above ballast cleaning screen 15 for discharging the excavated and conveyed ballast onto the screen. In a generally well known manner, an eccentric drive vibrates screen 15 for cleaning the excavated ballast in screen arrangement 15, conveyor band 16 receiving the cleaned ballast from the screen and redistributing it under the track behind excavating point 13 while longitudinally extending conveyor arrangement 17 removes the waste coming from ballast cleaning screen 15. Track lifting unit 18 is mounted on machine frame 4 at excavating point 13 to raise the track during the excavating operation.

As shown in FIG. 2, ballast excavating beams 26 of the two units 7, 8 are staggered from each other in the longitudinal machine frame extension direction and each excavating beam 26 is arranged for receiving and conveying ballast from opposite sides of the track with respect to longitudinal center line 30 of track 3. The ballast excavating beams are pivotal between end positions extending respectively substantially parallel to the center line of the track (see phantom lines in FIGS. 1 and 2) and transversely thereto (see full lines), and pivoting drives 29 are provided for pivoting ballast excavating beams 26.

Each ballast excavating beam 26 has chain guide element 27 with opposite longitudinally extending guide faces arranged to receive and guide endless excavating and conveying chain 10, and guide sprocket 31 is mounted at a free end opposite the one ballast excavating beam end at pivoting axis 28 for guiding endless chain 10 from one of the guide faces to the opposite guide face.

As shown in FIG. 2, deflection plate 33 is mounted at the lower chain track end adjacent pivoting axis 28 and remote from the respective machine frame side, the deflection plate extending in a vertical plane substantially parallel to the track. In this way, any excavated ballast centrifugally thrown outwards is deflected back to chain track 24, 25 for conveyance to discharge station 14. The chain track is universally movably pivoted to machine frame 4 near the upper end thereof.

As also shown in FIG. 2, ballast excavating beams 26 of the two units 7, 8 have a length corresponding approximately to a length of a regular track tie 3, and a leading ballast excavating beam in the operating direction is longer than the trailing ballast excavating beam. Chain tensioning device 37 for maintaining a constant tension of endless ballast excavating and conveying chain 10 is mounted on chain track 24, 25 closer to the upper than the lower end thereof.

As shown in FIG. 1, auxiliary chain 19 is vertically adjustably mounted on machine frame 4 ahead of unit 7, 8 in the operating direction, and drive 20 is provided for vertically adjusting auxiliary chain 19.

All the operating drives mounted on track maintenance machine 1, including the drive for moving the machine along track 3, receive their power from central energy source 21 mounted on the machine frame and are controlled from a control panel 23 in operator's cab 22.

In the embodiment illustrated in FIG. 2, endless ballast excavating and conveying chain 10 is comprised of excavating shovels 34 having scraping fingers 54 at their ends and universal links 32 connect the excavating shovels so that the chain may be deflected in all directions. Chain 10 is guided in a curved transition zone from descending chain track section 25 to the inwardly pivoted ballast excavating beam 26 by guide rollers 35 mounted on chain track section 25 at a side of ballast excavating and conveying chain 10 facing the respective machine frame side, guide rollers 35 being arranged adjacent vertical pivoting axes 28 of the ballast excavating beam for engaging scraping fingers 54 of excavating shovels 34 and being freely rotatable about vertical axes 36 spaced from the chain track and the ballast excavating beam. While the illustrated chain guide structure is very efficient, other chain guide systems may be used and the present invention is not limited to the illustrated embodiments.

Figure 3:
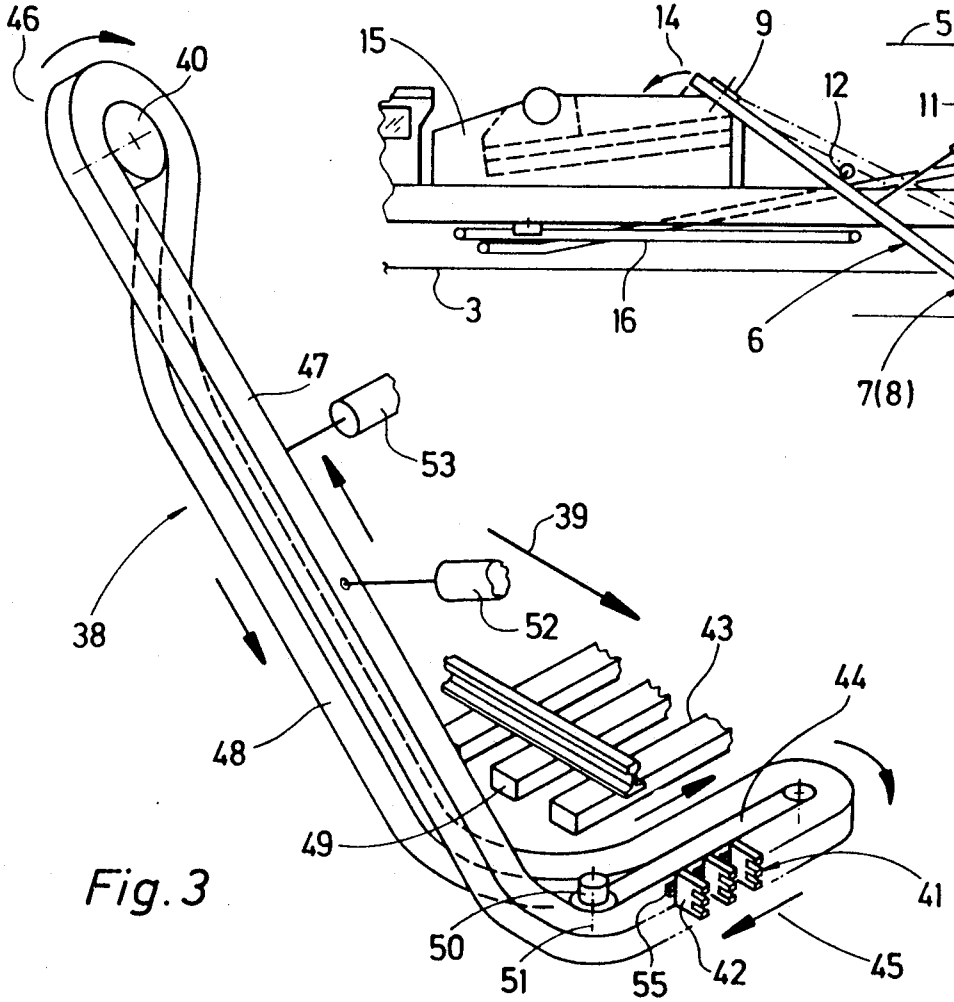
FIG. 3 is a schematic perspective view of another embodiment of a ballast excavating unit according to the invention.

FIG. 3 illustrates another embodiment of a ballast excavating and conveying unit. Illustrated unit 38 is positioned at the right shoulder of track 43, as seen in the operating direction indicated by arrow 39 (a like unit positioned at the opposite shoulder not being shown in this figure). Endless ballast excavating and conveying chain 41 comprised of excavating shovels 42 interconnected by universal links 55 is driven by drive 40 in ascending chain track section 47 and descending chain track section 48. The track sections 47, 48 are vertically staggered in an operative position alongside the machine frame, particularly adjacent tie ends 49 so that the width of unit 38, measured transversely on track 43, may be as small as possible. Such a ballast excavating and conveying unit may, therefore, be used at track sections leaving little room next to tie ends 49.

As shown in FIG. 3, ballast excavating beam 44 is pivoted to the lower end of chain track 47, 48 for being pivoted in a horizontal plane under track 43 by drive 50 about vertical axis 51 at excavating point 45. The excavated ballast is conveyed along ascending chain track section 47 to trailing upper end 46 of the chain track whence it is discharged in the manner explained hereinabove in connection with the previously described embodiment. Also as in that embodiment, vertical drive 52 and transverse drive 53 are connected to the chain track for vertically and transversely adjusting unit 38.

The operation of the ballast cleaning machine will partly be obvious from the preceding description of its structure and will be further explained hereinafter.

When ballast cleaning machine 1 is moved from one operating site to another along track 3, ballast excavating and conveying units 7 and 8 are lifted by drives 11 to a rest position (shown in phantom lines in FIG. 1), in which ballast excavating beams extend substantially parallel to center axis 30 of the track. When the machine arrives at an operating site, such as a transition from a tangent track to a branch track, auxiliary chains 19 at the track shoulders are lowered into engagement with the ballast while the machine is slowly driven forwardly in the operating direction indicated by arrow 5 or 39. The auxiliary chain cuts a ditch into the ballast during this slow forward movement of the machine and drives 11 or 52 are now operated to lower units 7, 8 or 38 and their ballast excavating beam 26 or 44 into the ditch. At the same time, drives 20 are operated to lift auxiliary chains 19 into a rest position shown in phantom lines in. FIG. 1. Drives 9 or 40 are now operated to drive endless chains 10 or 41 and drives 29 or 50 are operated to pivot the ballast excavating beams into their transversely extending operating positions underneath the track. The relaxation of the endless chains resulting from the pivoting of the beams is compensated by operation of chain tensioning device 37 of a generally conventional structure.

As the machine advances in the operating direction to a track switch section shown in phantom lines in FIG. 2, ballast excavating and conveying unit 8 at the side of the branch track is continuously transversely adjusted by operation of drive 12 in accordance with the increasing length of the track ties. This adjustment is remote-controlled from control panel 23 in cab 22 without interrupting the forward movement of ballast cleaning machine 1. When the largest transverse adjustment has been reached, ballast excavating beam 26 or 41 is pivoted to assume a position extending parallel to the branch track, unit 8 or 38 is lifted and transversely displaced back to its position adjacent the side of machine frame 4.

What is claimed is:

1. A conveyor chain arrangement for a track maintenance machine comprising a machine frame, the conveyor chain arrangement being mounted on the machine frame for receiving and conveying ballast supporting a track defining a plane, and the conveyor chain arrangement comprising (a) two separate and independently operable ballast receiving and conveying units at opposite sides of the machine frame extending alongside the track, each unit comprising (1) a vertically and transversely adjustable chain track extending longitudinally in an oblique plane with respect to the track plane adjacent a respective one of the machine frame sides, each chain track consisting of two track sections, (2) drive means connected to the chain track for vertically and transversely adjusting the chain track, (3) an endless ballast excavating and conveying chain guided in the chain track and extending about a ballast excavating beam, (4) a chain drive for the chain, and (5) said ballast excavating beam having pivoted connection means attached to a lower end of the chain track for pivoting about a substantially vertical axis in a horizontal plane underneath and substantially parallel to the track plane during operation whereby the effective width of ballast excavation may be changed, an upper end of the chain track providing a ballast discharge station spaced from the ballast excavating beam in the direction of a longitudinal extension of the machine frame and the lower chain track end forming a bent transition to the ballast excavating beam, the bent transition having an end leading to the ballast excavating beam and extending substantially parallel to the track plane beam.

2. The conveyor chain arrangement of claim 1, wherein the ballast excavating beams of the two units are staggered from each other in the longitudinal machine frame extension direction, each excavating beam being arranged for receiving and conveying ballast from opposite sides of the track with respect to a longitudinal center line of the track.

3. The conveyor chain arrangement of claim 2, wherein the ballast excavating beams are pivotal between end positions extending respectively substantially parallel to the center line of the track and transversely thereto, and further comprising pivoting drives for pivoting the ballast excavating beams.

4. The conveyor chain arrangement of claim 1, wherein the ballast excavating beam has opposite longitudinally extending guide faces arranged to receive and guide the endless excavating and conveying chain, and further comprising a guide sprocket at a free end opposite the one ballast excavating beam end for guiding the endless chain from one of the guide faces to the opposite guide face.

5. The conveyor chain arrangement of claim 1, further comprising a deflection plate mounted at the lower chain track end adjacent the pivoting axis and remote from the respective machine frame side, the deflection plate extending in a vertical plane substantially parallel to the track.

6. The conveyor chain arrangement of claim 1, wherein the chain track is universally movably pivoted to the machine frame near the upper end thereof.

7. The conveyor chain arrangement of claim 1, wherein the two chain track sections are vertically staggered in an operative position alongside the machine frame.

8. The conveyor chain arrangement of claim 1, wherein the ballast excavating beams of the two units are staggered from each other in the longitudinal machine frame extension, the beams having a length corresponding approximately to a length of a regular track tie, and a leading one of the ballast excavating beams in an operating direction being longer than the trailing ballast excavating beam.

9. The conveyor chain arrangement of claim 1, wherein the endless ballast excavating and conveying chain is comprised of excavating shovels having scraping fingers at their ends and universal links connecting the excavating shovels.

10. The conveyor chain arrangement of claim 9, further comprising guide rollers at a side of the ballast excavating and conveying chain facing the respective machine frame side, the guide rollers being arranged adjacent the vertical pivoting axes of the ballast excavating beam for engaging the scraping fingers of the excavating shovels and being freely rotatable about vertical axes spaced from the chain track and the ballast excavating beam.

11. The conveyor chain arrangement of claim 1, further comprising a chain tensioning device for maintaining a constant tension of the endless ballast excavating and conveying chain.

12. The conveyor chain arrangement of claim 11, wherein the chain tensioning device is mounted on the chain track closer to the upper than the lower end thereof.

13. The conveyor chain arrangement of claim 1, further comprising an auxiliary chain vertically adjustably mounted on the machine frame ahead of the unit in an operating direction, and a drive for vertically adjusting the auxiliary chain.

14. The conveyor chain arrangement of claim 1, wherein the upper chain track end projects above a ballast cleaning screen for discharging the excavated and conveyed ballast onto the screen.

* * * * *